United States Patent [19]

Ohmi

[11] 4,305,441

[45] Dec. 15, 1981

[54] ROTARY CUTTER

[75] Inventor: Shohei Ohmi, Anjo, Japan

[73] Assignee: Ohmi Kogyo Co. Ltd., Anjo, Japan

[21] Appl. No.: 121,069

[22] Filed: Feb. 13, 1980

[51] Int. Cl.[3] ..... B27B 33/00

[52] U.S. Cl. ..... 144/238

[58] Field of Search ..... 83/698; 144/218, 238

[56] References Cited

U.S. PATENT DOCUMENTS

| | | | |
|---|---|---|---|
| 563,123 | 6/1896 | Bissell | 144/238 |
| 682,810 | 9/1901 | Parks | 144/238 |
| 706,770 | 8/1902 | Miller | 144/238 |
| 1,568,199 | 1/1926 | Watson | 144/238 |
| 2,544,814 | 3/1951 | Warren | 144/238 |
| 3,780,780 | 12/1973 | Pettigrew et al. | 144/238 |
| 3,848,512 | 11/1974 | Erhardt | 144/238 |
| 4,018,256 | 4/1977 | Niehaus et al. | 144/238 |
| 4,055,204 | 10/1977 | Gunzner et al. | 144/238 |

*Primary Examiner*—W. D. Bray

*Attorney, Agent, or Firm*—Jordan and Hamburg

[57] ABSTRACT

A rotating arbor in a sawing machine such as a table saw or radial saw or in a milling machine is provided with a pair of pressing members that are mounted on the arbor so as to be rotated in unison therewith, and a bearing sleeve which is provided on the arbor between the pressing members so as to be rotatable in unison therewith. A rotary blade for forming a groove is clamped from both sides thereof by a pair of clamping members which are mounted on the bearing sleeve in a tilted orientation for holding the rotary blade at an inclined angle with respect to the arbor, the clamping members being pressed between, and hence secured by the pair of pressing members. Turning both clamping members relative to the pressing members allows the clamping members to be tilted together with the rotary blade with respect to the central axis of the arbor. To effect this tilting operation in a smooth manner, either the outer periphery of the bearing sleeve or the inner periphery of a central hole in the clamping members is formed to include a spherical portion.

9 Claims, 11 Drawing Figures

ROTARY CUTTER

FIELD OF THE INVENTION

This invention relates to a rotary cutter of the type in which the rotary blade of a saw such as a table or radial saw or of a milling machine or the like is mounted at an inclined angle and adapted to cut a groove of any desired width.

OBJECTS OF THE INVENTION

It is an object of the present invention to provide a rotary cutter in which the angle of inclination of a rotary blade can be changed smoothly at will to enable the rotary blade to readily cut grooves of various widths.

It is another object of the present invention to provide a rotary cutter, in which the floor of a groove cut by a rotary blade can be formed to have a subtantially flat surface at all times regardless of the width of the groove.

It is still another object of the present invention to provide a rotary cutter in which a pair of pressing members and a pair of clamping members can each be turned in unison when the pair of pressing members and the pair of clamping members are turned and adjusted relative to one another, and when the pair of clamping members and the rotary blade are turned and adjusted relative to one another.

These and other objects of the present invention as set forth in the appended claims will become apparent from the following description of a preferred embodiment, and numerous advantages not hereinafter set forth will occur to those skilled in the art upon working the present invention.

DETAILED DESCRIPTION OF THE PREFERRED EMBODIMENTS

Figure 3:
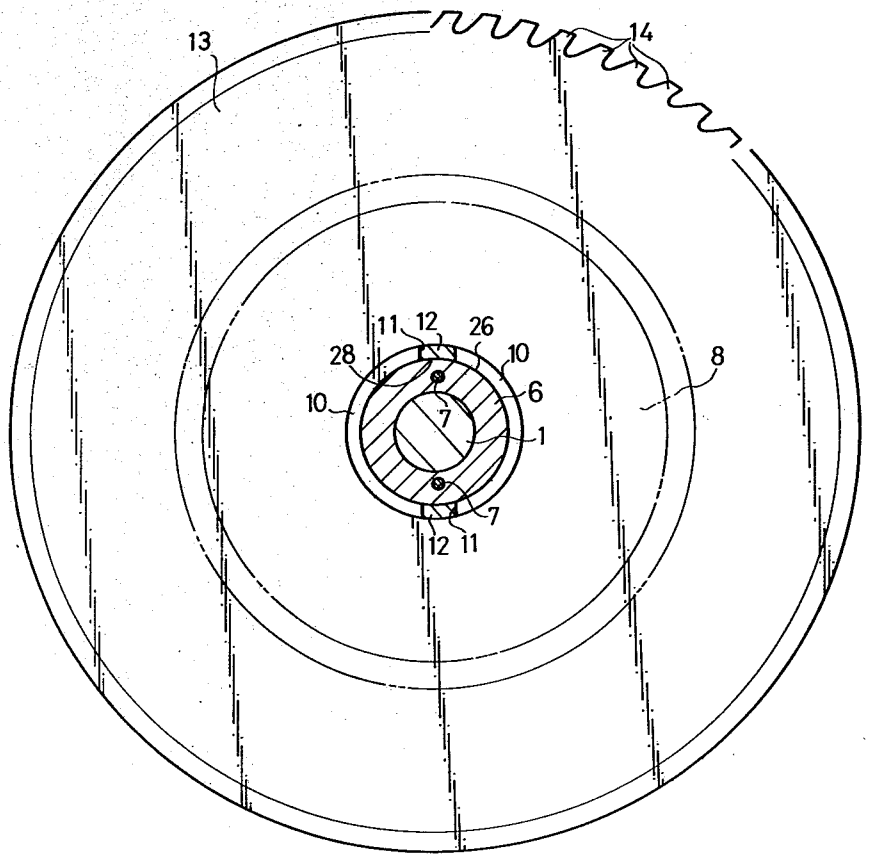
FIG. 3 is a cross-sectional view taken along line III—III of FIG. 1.
Figure 1:
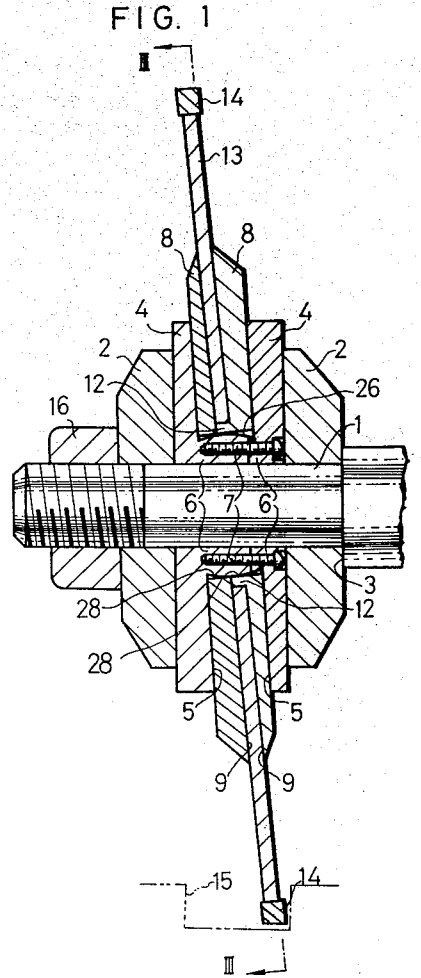
FIG. 1 is a cross-sectional view of a rotary cutter embodying the present invention.

Reference will now be made to the accompanying drawings for a description of embodiments of the invention. A rotating arbor 1 of a sawing or milling machine or the like is provided with a pair of holding disks 2, the surface on the right-hand side of the rightward holding disk being in abutting engagement with a step portion 3 formed in the rotating arbor 1. A pair of pressing disks 4 are mounted on the arbor 1 between the pair of holding discs 2 and are tightly secured between the holding disks by pressured contact so as to be capable of rotating in unison with the arbor. The mutually opposing inside surfaces of the pressing disks 4 are formed to include respective inclined surfaces 5 that are in parallel relationship with one another. The central portion of each inclined surface 5 of the pressing disks 4 is projectively provided with a pair of bearing sleeves 6, the outer circumferential surfaces of this pair of bearing sleeves forming a spherical portion 26 whose center is a point on the central axis of the arbor 1 when the end faces of the respective bearing sleeves are in a state of abutting contact with each other. One of the bearing sleeves projects by a greater length than the other. A pair of fastening screws 7 are passed from the outside through the pressing disk 4 having the shorter bearing sleeve 6 and are screwed into the longer bearing sleeve 6 on the other pressing disk 4 to couple both pressing disks together so that they can rotate in unison. Provided between the pressing disks 4 so as to be penetrated by the bearing sleeve 6 is a pair of clamping disks 8 firmly secured between the pressing disks by pressured contact. The inner peripheral surface of a hole 28 for receiving the bearing sleeves 6 is not curved but extends linearly in the axial direction as shown in FIG. 1. Relieving the pressured contact between the clamping disks 8 and pressing disks 4 permits the pair of clamping disks 8 and pair of pressing disks 4 to be turned relative to one another. The mutually opposing inside surfaces of the clamping disks 8 are formed to include inclined surfaces 9 that are in parallel relationship with one another.

Figure 2A:
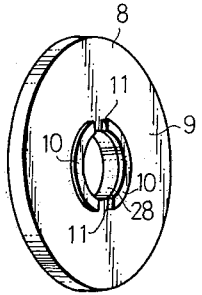
FIGS. 2A and 2B are perspective views of clamping disks.
Figure 2B:
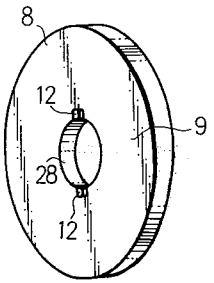

The central portion of the inclined surface 9 on one of the clamping disks 8 is provided with a ring-shaped projection 10 which is formed to include a pair of engagement recesses 11, as illustrated in FIG. 2A, one recess being located in the upper portion of the ring-shaped projection 10 and the other in the lower portion thereof. The inclined surface of the other clamping disk 8 is provided with a pair of upper and lower engagement projections 12 at locations corresponding to the engagement recesses 11, the projections 12 serving to join both clamping disks together when the projections 12 are fitted into the corresponding recesses 11 so that the clamping disks can rotate in unison. Clamped securely between the clamping disks 8 is a rotary cutting blade 13 having a central hole 23 (see FIG. 8) through which the ring-shaped projection 10 and engagement projections 12 pass. The rotary cutting blade 13 is capable of being set perpendicular to the axis of the arbor 1 or at an inclination with respect thereto. Removing the pressing action of the clamping disks 4 permits the rotary blade 13 and the pair of clamping disks to be turned relative to one another.

The outer periphery of rotary blade 13 includes a multiplicity of cutting elements 14 having cutting edges whose angle of inclination successively changes, as shown in FIG. 4. More specifically, the rotary blade 13 has an overall elliptical configuration, so that the angle of inclination of the cutting elements successively changes from a maximum value for cutting elements $A_1$, $A_2$ for cutting both inner sides of a groove 15 of predetermined width, to a value of zero for cutting elements $C_1$, $C_2$ for cutting the central portion of the groove 15, and so that the cutting elements $A_1$, $A_2$ lengthen while the cutting elements $C_1$, $C_2$ shorten.

Figure 4B:
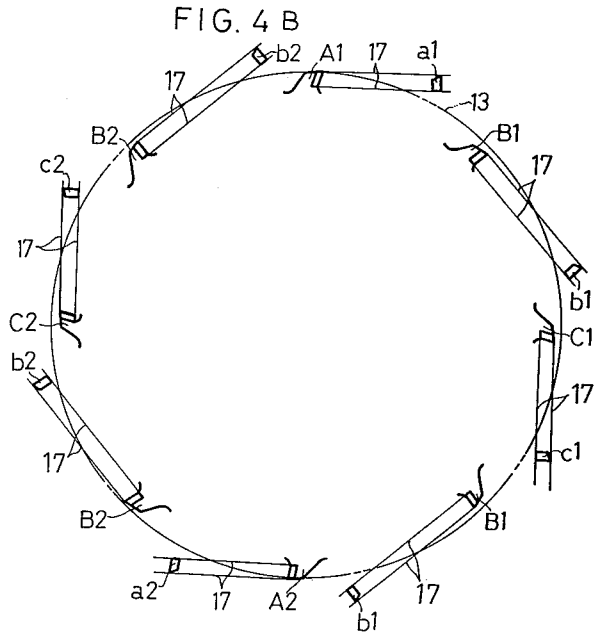
FIG. 4B is a diagram useful in describing the blade edge configuration of a multiplicity of cutting elements on the outer periphery of a rotary blade.
Figure 4A:
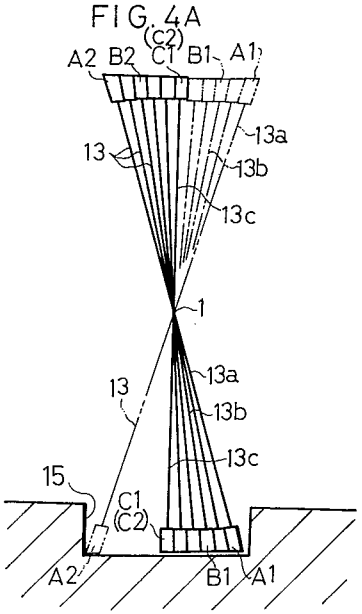
FIG. 4A is a diagram useful in describing the condition under which a groove is cut by a rotary blade.

In FIG. 4A, a plurality of lines 13a~13c symbolically represent the vertical and inclined attitudes of the rotary blade 13. In FIG. 4B, cutting elements $a_1 \sim c_2$, represented by drawing lines 17 from each of the cutting elements $A_1 \sim C_2$ and extending the lines in a direction substantially tangential to the rotary blade 13, are projections of each of the cutting elements $A_1 \sim C_2$ as viewed substantially from the tangential direction.

Screwed onto the end portion of arbor 1 is a nut 16 which cooperates with the step portion 3 of the arbor 1 to tightly clamp such elements as the pairs of holding disks 2, pressing disks 4 and clamping disks 8.

Cutting the groove 15 as shown in FIG. 4A by utilizing the rotary blade 13 of the foregoing construction is accomplished by rotating the blade together with the arbor 1. Upon so doing, the angled portions on either side of the groove 15 are cut by the cutting elements $A_1$, $A_2$ which have the maximum length and whose cutting edges have the maximum angle of inclination. As cutting proceeds, the groove 15 is cut successively inwardly from both of the angled portions by a multiplicity of cutting elements $B_1$, $B_2$ which become gradually shorter than the cutting elements $A_1$, $A_2$ and whose cutting edges have an angle of inclination which also becomes gradually smaller than that of the cutting elements $A_1$, $A_2$. The central portion of groove 15 is then cut by the cutting elements $C_1$, $C_2$ which are the shortest of the cutting elements and which have cutting edges of the smallest angle of inclination. This makes it possible to cut a groove 15 having a flat or level floor.

The angle of inclination of the rotary blade 13 is changed to alter the width of formed groove 15. This is accomplished by turning and adjusting the rotary blade 13 with respect to the pair of pressing disks 4, together with both clamping disks 8.

When performing this adjustment, the pair of clamping disks 8 are tilted along the outer circumferential surface of the bearing sleeve 6 of pressing disks 4. At such time, since the outer circumferential surface of the bearing sleeve 6 has the form of the spherical portion 26, both clamping disks 8 will assuredly tilt smoothly along the spherical surface portion 26 while being held in linear contact with this surface at any position thereon, the line of contact between the spherical surface portion 26 and clamping disks 8 defining a circle. When the tilting adjustment has been completed, the rotary blade 13 is clamped stably on the bearing sleeve 6 and will not vibrate radially of the arbor.

Figure 9:
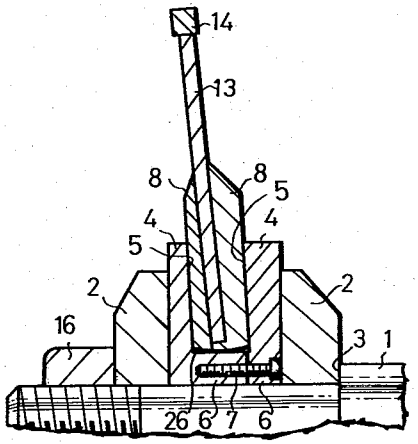
FIGS. 7, 8 and 9 are respective partial cross-sectional views of further embodiments of a rotary cutter according to the present invention.
Figure 8:
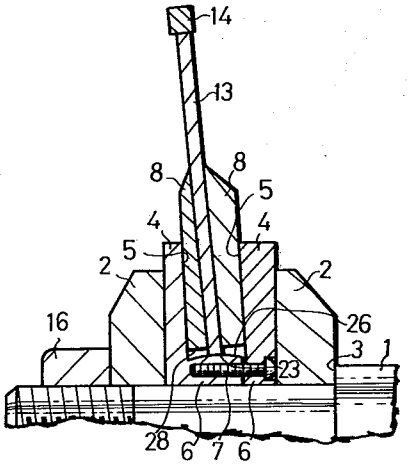
Figure 7:
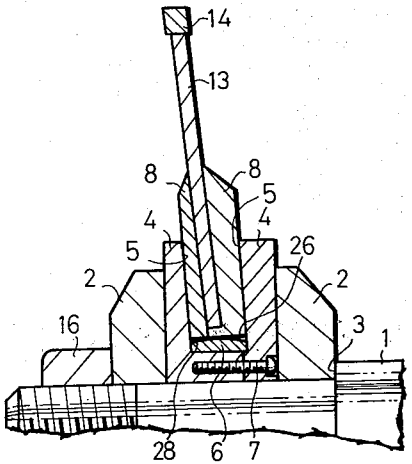

It should be noted that tilting the clamping disks 8 and rotary blade 13 can also be accomplished if the bearing sleeve 6 is formed separate from the pair of pressing disks 4, as shown in FIG. 7, or if the inner peripheral surface of the central hole 23 in the rotary blade 13 is abutted directly against the spherical portion 26 of the bearing sleeve 6, as shown in FIG. 8, or if, instead of the outer circumferential surface of the bearing sleeve 6, the inner peripheral surface of the hole 28 in the pair of clamping plates 8 is provided with the spherical surface 26 (in FIG. 9).

Figure 5:
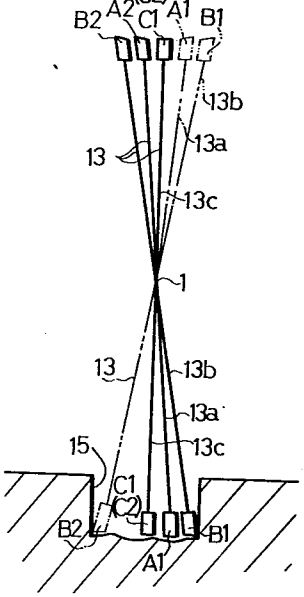
FIG. 5 is a diagram useful in describing the conditions under which a narrow groove is cut by the above-mentioned rotary blade.

In order to change the width of the groove 15 as described above, for example, when forming a narrow groove as shown in FIG. 5 with the blade 13 adjusted to form a long groove as shown in FIG. 4A, the attitudes of the pressing disks 4, clamping disks 8 and rotary blade 13 are changed relative to one another. That is, the clamping disks 8 are turned with respect to the pressing disks 4 to select the width of the groove to be cut. Once the clamping disks 8 are positioned against the pressing disks 4, and as long as the attitudes of the rotary blade 13 and clamping disks 8 are not corrected relative to one another, the cutting elements $A_1$, $A_2$ of maximum length and whose cutting edges have the maximum angle of inclination, will not cut the side walls of the groove 15, contrary to what is intended. Instead, other cutting elements such as cutting elements $B_1$, $B_2$ will cut the side walls, and the cutting elements $C_1$, $C_2$ will cut the center of the groove 15, and the cutting elements $A_1$, $A_2$ will cut portions between the center and the sides. If the angled portions inside the groove 15 are cut by the cutting elements $B_1$, $B_2$, the floor of the groove, with the exception of the angled portions, will be cut by the cutting elements $A_1$, $A_2$, $C_1$, $C_2$. As a result, the floor of the groove 15 will come to have an uneven surface instead of a flat or level surface.

The formation of the uneven groove floor in this manner would be the same also for a case in which the angle of inclination of the rotary blade 13 is enlarged to cut a wider groove.

Figure 6:
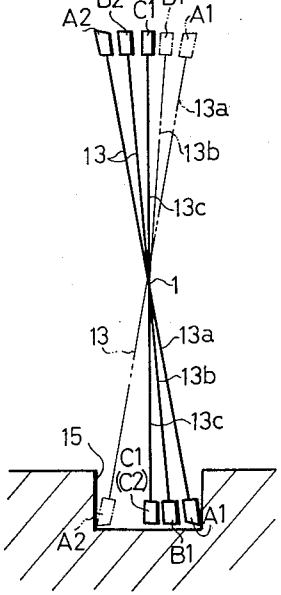
FIG. 6 is a diagram useful in describing the conditions under which a narrow groove is cut, with the above-mentioned rotary blade having been turned and adjusted with respect to a pair of clamping disks.

Accordingly, when altering the angle of inclination of the rotary blade 13 in the foregoing embodiment, the clamping disks are turned with respect to the pressing disks 4 to substantially select the width of the groove to be cut, and then the rotary blade 13 is turned and adjusted relative to the pair of clamping disks 8, whereby the positions of the cutting elements $A_1$, $A_2$, which are of maximum length and have the cutting edges of maximum inclination, are determined so that the cutting elements $A_1$, $A_2$ will cut the angled portions inside the groove 15 on both sides thereof, as shown in FIG. 6.

Thus, from among the multiplicity of cutting elements 14 on the rotary blade 13, the cutting elements $A_1$, $A_2$ always cut the angled portions inside groove 15, the cutting elements $B_1$, $B_2$ cut the positions inwards of the groove sides, and the cutting elements $C_1$, $C_2$ cut the central portion at the bottom of the groove. As a result, the floor of the groove 15 becomes substantially flat or level without any extreme unevenness regardless of groove width.

With the present invention as described above, a rotary blade, together with a pair of clamping members, is brought into linear contact with a bearing sleeve, so that the rotary blade can be assuredly and stably supported so as not to vibrate in the radial direction regardless of the angle of inclination of the rotary blade. Moreover, the rotary blade can be tiltably adjusted in a smooth manner along a spherical portion provided on the bearing sleeve.

While the present invention has been described in some detail with regard to preferred embodiments thereof, it is obvious that widely different embodiments of the present invention can be made without departing from the spirit and scope thereof. It is also to be understood that the present invention is not limited to the specific embodiments thereof except as defined in the appended claims.

What is claimed is:

1. A rotary cutter of a type adapted to be secured on a rotatable arbor by holding means, comprising:

a pair of pressing members immovably situated on the arbor by the holding means for rotation together with said arbor, said pressing members having outer pressing surfaces perpendicular to an axis of said arbor, inner pressing surfaces inclined to the axis of said arbor, said inner pressing surfaces facing and extending parallel to one another, and annular shoulders provided at innermost ends thereof, said annular shoulders projecting inwardly from the respective pressing members and abutting each other;

a pair of clamping members provided on said annular shoulders and immovably situated between said inner pressing surfaces of said pressing members, said clamping members having outer clamping surfaces parallel to each other and inner clamping surfaces inclined against said outer clamping surfaces, said inner clamping surfaces facing and extending parallel to one another so that when said clamping members are turned against said pressing members, angle of said inner clamping surfaces to said arbor changes; and a rotary blade secured between said inner clamping surfaces of said clamping members and having a plurality of cutting elements on the periphery thereof, said cutting elements having cutting edges with acute cutting angles between a line perpendicular to both a tangential line and a radial line of the rotary blade at a point on the outer periphery thereof and a line parallel to the axis of the arbor at said point on the blade, said cutting angles changing successively from a maximum to zero for respective portions of a groove to be cut;

whereby after said clamping members are set against said pressing members to determine an inclination angle relative to said arbor, said rotary blade is rotated against said clamping members to adjust the position of the cutting edges for properly cutting the groove by predetermined cutting edges so that the desired shape groove can be obtained.

2. A rotary cutter according to claim 1, in which said rotary blade has an elliptical configuration, said cutting edges at the greatest diameter portions of said elliptical blade having maximum cutting angles, said cutting edges at the smallest diameter portions having cutting angles of zero, and the other cutting edges having cutting angles successively changing from maximum to zero so that the outer surfaces of said cutting edges are substantially parallel to said arbor to thereby form a groove having a flat bottom and perpendicular side walls.

3. A rotary cutter according to claim 2, in which after the inclination angle of the clamping members to the axis of the arbor is set to determine the width of the groove to be cut, the rotary blade is turnable against the clamping members so that said cutting edges of the maximum cutting angles are located on a line extending along said inclination angle of the clamping members.

4. A rotary cutter according to claim 1, in which said annular shoulders of said pressing members are integrally provided with a spherical bearing sleeve on outer surfaces thereof, said clamping members having straight cylindrical center openings communicating with one another and of the same diameter as that of the spherical bearing sleeve, so that said clamping members are properly supported by said spherical bearing sleeve regardless of the angle of the clamping members relative to said pressing members.

5. A rotary cutter according to claim 4, in which said pressing members include a plurality of fastening screws to connect the pressing members together, said fastening screws passing through one of the annular shoulders and being tightly engaged into another annular shoulder.

6. A rotary cutter according to claim 4, in which one of said clamping members includes an annular projection at an innermost end thereof and a plurality of recesses provided on the annular projection, another of said clamping members includes a plurality of projections to engage the recesses on the annular projection to thereby prevent slipping of the two clamping members, and said rotary blade is located outside the annular projections.

7. A rotary cutter according to claim 1, further comprising a bearing sleeve located between said annular shoulders of said pressing members and said clamping members, said bearing sleeve having a spherical portion on an outer surface thereof, said clamping members having straight cylindrical center openings communicating with one another and of the same diameter as that of the bearing sleeve so that said clamping members are properly supported by said bearing sleeve regardless of the angle of the clamping members relative to said pressing members.

8. A rotary cutter according to claim 1, in which said annular shoulders of said pressing members are integrally provided with a spherical bearing sleeve on outer surfaces thereof, said rotary blade having a central opening an inner surface of which is directly contacted by said spherical bearing sleeve, so that said rotary blade is supported by and freely changeable in its angle relative to said pressing members.

9. A rotary cutter according to claim 1, in which said annular shoulders of said pressing members are of cylindrical form and extend straight in the axial direction of the arbor, said clamping members including inner openings with surfaces of partial spherical configuration extending inwardly therefrom so that each of the clamping members is supportable by and freely changeable in its angle relative to the pressing members.

* * * * *